United States Patent [19]

O'Neill

[11] Patent Number: 5,040,528

[45] Date of Patent: Aug. 20, 1991

[54] AUTONOMOUS BREATHING SYSTEM FOR UNDERWATER DIVER'S HEADGEAR

[76] Inventor: Wilbur J. O'Neill, 319 Hollyberry Rd., West Severna Park, Md. 21146

[21] Appl. No.: 421,190

[22] Filed: Oct. 13, 1989

[51] Int. Cl.[5] ..... B63C 11/02

[52] U.S. Cl. ..... 128/201.27; 128/205.28

[58] Field of Search ..... 128/201.24, 201.25, 128/201.27, 201.28, 202.26, 205.28, 205.12

[56] References Cited

U.S. PATENT DOCUMENTS

| | | | |
|---|---|---|---|
| 2,238,759 | 4/1941 | Vestrem | 128/201.25 |
| 2,324,716 | 7/1943 | Nohl | 128/201.25 |
| 3,565,068 | 2/1971 | Bickford | 128/202.26 |

*Primary Examiner*—Aaron J. Lewis

*Attorney, Agent, or Firm*—Gipple & Hale

[57] ABSTRACT

A breathing system is described for underwater diving system which is particularly useful in emergency, "bail-out" situations where the diver's external support is terminated. The invention is particularly characterized by a gas recirculation and purification system which is entirely contained within the helmet and which functions to purify and recirculate exhaled gas within the helmet and to preserve heat generated by the reaction whereby $CO_2$ is purged from exhaled gas. The invention, further, conserves human respiratory heat by minimizing breathing gas exposure to cold surfaces.

15 Claims, 7 Drawing Sheets

AUTONOMOUS BREATHING SYSTEM FOR UNDERWATER DIVER'S HEADGEAR

SUMMARY OF THE INVENTION

The present invention is directed a fully autonomous underwater breathing system and in particular a bailout system for use in underwater diving in the event of emergencies where there is a complete disruption of umbilical support. The present invention is particularly characterized by providing an autonomous breathing system in which exhaled gas is recirculated through the diver's helmet with conservation and utilization of heat produced by the lungs and the gas recirculation and purification system.

BACKGROUND OF THE INVENTION

In underwater breathing systems used by divers, the "push-pull" type breathing system supplies breathing gas from a remote source and returns exhaled gas to the source for $CO_2$ removal and oxygen replenishment. This type of system increases diver's safety and productivity by eliminating the burden and possible danger inherent in closed circuit, back worn systems. The "push-pull" mode of operation allows the changing of $CO_2$ absorbent canisters at the remote source of the gas, without interrupting the diver's work, in a single atmosphere control system that will suffice for several divers supplied from the same source.

For obvious safety reasons, such systems, as well as free-flow and demand systems, do require that backup units also be available in the event that there is interruption of the power and gas supply from the remote installation to the diver. In order to sustain the diver for at least a brief period of time in the event of a complete disruption of umbilical support, autonomous "bailout" systems are provided. Since such "bailout" systems must provide the necessary breathing gas for the diver independently of any connection to a remote location and remove carbon dioxide from the exhaled gas, these "bailout" systems typically include means for removing exhaled gas from the helmet, treating the exhaled gas to remove carbon dioxide and recirculating it to the helmet. In this system, as in all classic semi-closed mixed gas systems, oxygen is replentished by the controlled admission of gas mixtures.

A serious problem which however is encountered in autonomous "bailout" systems where there is a complete loss of umbilical power and heat, is the prevention of respiratory heat loss. Typically, bailout systems of the prior art have employed breathing bags with their inherent vulnerability to damage, flooding and heat loss, external hoses with inherent breathing resistance, heat loss and danger of entanglement, large, complex and heavy backpack equipment and externally mounted gas purification canisters which permit the heat generated by the lungs and the gas purification reaction to be dissipated without providing any warming of the inhaled gas.

It is accordingly an object of the present invention to provide a "bailout" system for use in underwater diving systems in the event of disruption of external support in which heat generated by the exothermic reaction occurring when carbon dioxide is absorbed from respiratory gas is used to warm the recirculated respiratory gas and surrounding environment inside the helmet, thereby preventing or at least minimizing respiratory heat loss.

Yet a further object of the present invention is to provide a "bailout" breathing system for underwater diving in which both heat and respiratory gas are preserved within the helmet.

Yet a further object of the present invention is to provide an emergency "bailout" system for underwater diving in which the gas recirculation system used including the means for purging carbon dioxide from exhaled gas is totally contained within the diving helmet thereby eliminating external tubes, canisters and other vulnerable encumbrances.

DETAILED DESCRIPTION OF THE INVENTION

Figures 1, 2, 3:
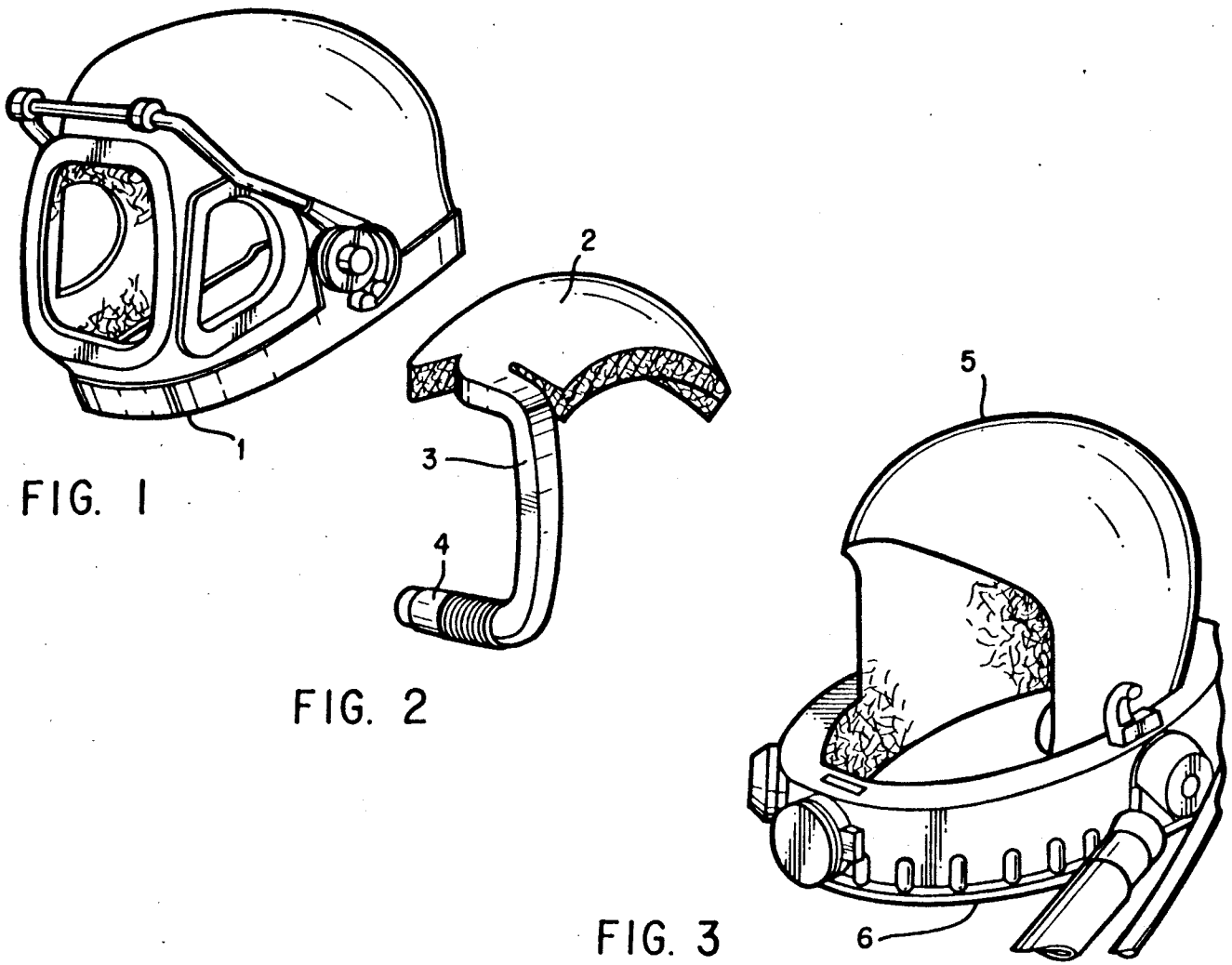
FIG. 1 is a perspective view of an outer helmet used in accordance with the present invention.
FIG. 2 is a perspective view of a portion of the breathing assembly of the invention including the mouthpiece, ducting and gas purification canister.
FIG. 3 is a perspective view of the inner liner and valve ring used in accordance with the present invention.

In accordance with the present invention, a breathing system is provided for underwater diving which is particularly useful in situations where external support through an umbilical is terminated and the diver must proceed autonomously at least for a limited period of time. The breathing system of the present invention essentially comprises an outer helmet of generally conventional design along with an inner liner adapted to fit within the helmet. A flexible neck dam is provided to prevent ingress of water into the helmet or egress of gas out of the headgear. The flexible neck dam can be adjustable to provide for variation in the compliant volume of the helmet breathing space. A gas recirculation and purification system is provided in accordance with the invention which is entirely contained within the headgear. This gas recirculation and purification system permits the occupant of the helmet to breath and function independently of any external support system. Supplemental gas is provided by means of several relatively small tanks which can be worn on the diver's back and which are connected into the helmet to provide a supplemental gas mixture containing oxygen to the diver.

The gas recirculation and purification system of the invention, which is contained wholly within the headgear, functions to remove carbon dioxide from exhaled gas while permitting it to then be recirculated within the environment of the helmet where the diver can breath it. A particularly important feature of the present invention is that heat generated by the exothermic reaction between the absorbed carbon dioxide and the chemical absorbent is actually preserved within the space of the helmet rather than being dissipated into the outside environment. To avoid the possibility of overheating, for example in warm water environments, the present invention permits adjustment of the gas purification canister to increase heat dissipation through the walls of the helmet to the outside environment.

The gas purification system of the present invention consists of an adjustable mouthpiece connected by means of a duct to a canister wholly disposed within the helmet and containing a chemically reactive absorbent such as for removing carbon dioxide from exhaled gas. Once the exhaled gas has passed through the absorbent material in the canister, it is recirculated within the helmet where it is supplemented by a source of externally supplied oxygen containing gas and is available for breathing by the diver. As will become apparent on considering in detail the drawings of the present invention, the gas purification canister of the invention is shaped to conform and fit within a space provided in the upper dome of the helmet between the liner and the upper interior surface of the helmet. A variable space is provided between the top of the canister and the interior helmet surface to facilitate controlled heat dissipation into the interior volume of the helmet and to permit heat dissipation into the outside environment when desirable. Where it is desired to maximize heat dissipation outside of the helmet, this variable space can be minimized or even done away with by placing the canister in direct contact with the upper interior surface of the helmet so that heat is dissipated directly through the helmet wall to the outside.

The purification canister itself is essentially an air permeable curved planar structure having plural chambers containing the carbon dioxide absorbent composition and a common plenum for distributing untreated exhaust gas to these chambers. The plenum is connected by a duct to the mouthpiece which the diver uses to exhale gas from his body. Gas flow within the purification canister is from the plenum, which is centrally located, outward through the canister chambers and the gas permeable walls into the helmet environment.

Additionally, the present invention can, with slight modification, function in a two way manner in which the diver both inhales and exhales through the mouthpiece into the duct leading to/from the purification cannister. In this two way embodiment, therefore, inhaled gas passes from the environment of the helmet into and through the purification cannister to the diver. Exhaled gas passes in the opposite direction through and out of the canister. The only modification of the system required for the two way mode is to eliminate check valves and screen off exit gas from leaving the mouthpiece directly into the helmet.

The present invention and its various embodiments and modification will however be more fully appreciated by having specific reference in detail to the appended drawings which illustrate a preferred embodiment thereof.

DETAILED DESCRIPTION OF THE DRAWINGS

Figure 4:
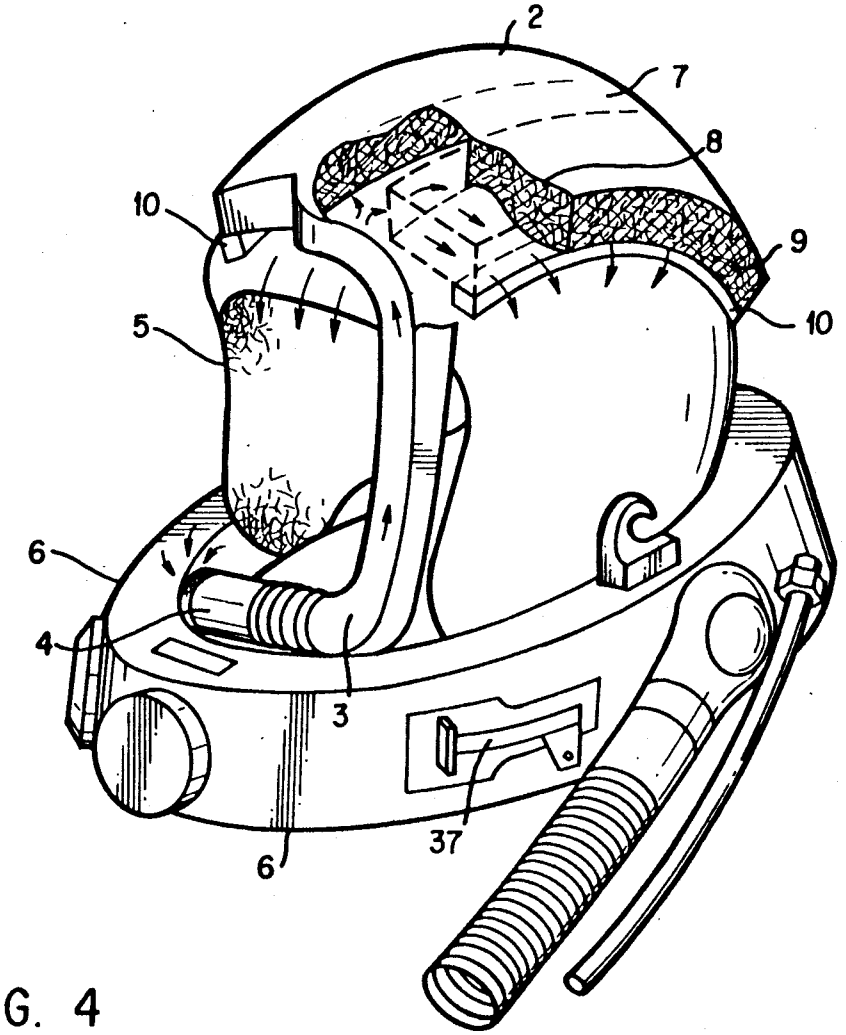
FIG. 4 is a partial cutaway perspective view of the inner helmet liner, valve ring and breathing assembly together.

Directing attention to FIGS. 1, 2 and 3 of the drawings, the three major components of the present invention are illustrated. The outer diver's helmet 1 is of generally conventional design and various modifications can be employed herein within the scope of the present invention. FIG. 3 illustrates the inner liner of the underwater diver's helmet together with the valve ring and neck dam 6 to which the outer helmet attaches. A heat exchange conduit can also be integrated into the valve ring 6 to transport warm water in normal (push-pull) and standby modes from an external source partially around ring to provide heating to the interior of the helmet and to preheat the valve ring casting in order to prolong heat retention during autonomous use. The gas purification and recirculation system of the present invention is illustrated in FIG. 2 and consists primarily of the mouth piece 4, into which the diver exhales, connected by duct 3 to the curved planar canister 2. As shown in FIG. 4 of the drawings, the canister is curved to fit between the liner 5 and the interior upper surface of the helmet 1. Spacers 10 are shown between the underside of the canister 2 and the upper surface 5 to provide a space between the liner and the canister and permit circulation of heated gas between the canister and the liner during normal and standby modes. Although not illustrated in the drawings, a variable space is also provided between the upper surface of the canister and the lower interior surface of the helmet to permit heat dissipated from the canister to circulate within the interior volume of the helmet. When it is desired to dissipate some of the generated heat outside of the helmet, the position of the canister can be adjusted to decrease the space between the canister and the interior surface of the helmet. The canister 2 is constructed of two generally parallel chambers with a central plenum 7 disposed between them. Each of the chambers contains a commercially available conventional carbon dioxide absorbent material such as a mixture of alkaline hydroxides, for example calcium, sodium and potassium hydroxides sold as "Sodasorp HP". The sides of each of the carbon dioxide absorbing chambers of the canister are enclosed by a gas permeable material such as a screen which is sufficiently fine to retain the absorbent material but permit gas to pass from the central plenum through both chambers and emerge outside into the environment of the helmet in the direction indicated by the arrows in FIG. 4 of the drawings. The top and bottom surfaces, front and back of the canister are of solid construction so that gas is forced through the absorbent chambers and out in the indicated directions.

Since the absorption of carbon dioxide in the exhaled gas is an exothermic reaction, heat is generated in the canister and dissipated through the walls of the canister into the environment of the helmet. Advantageously, the gas impermeable walls of the canister can be made for example of brass or other heat conductive materials.

Figure 5:
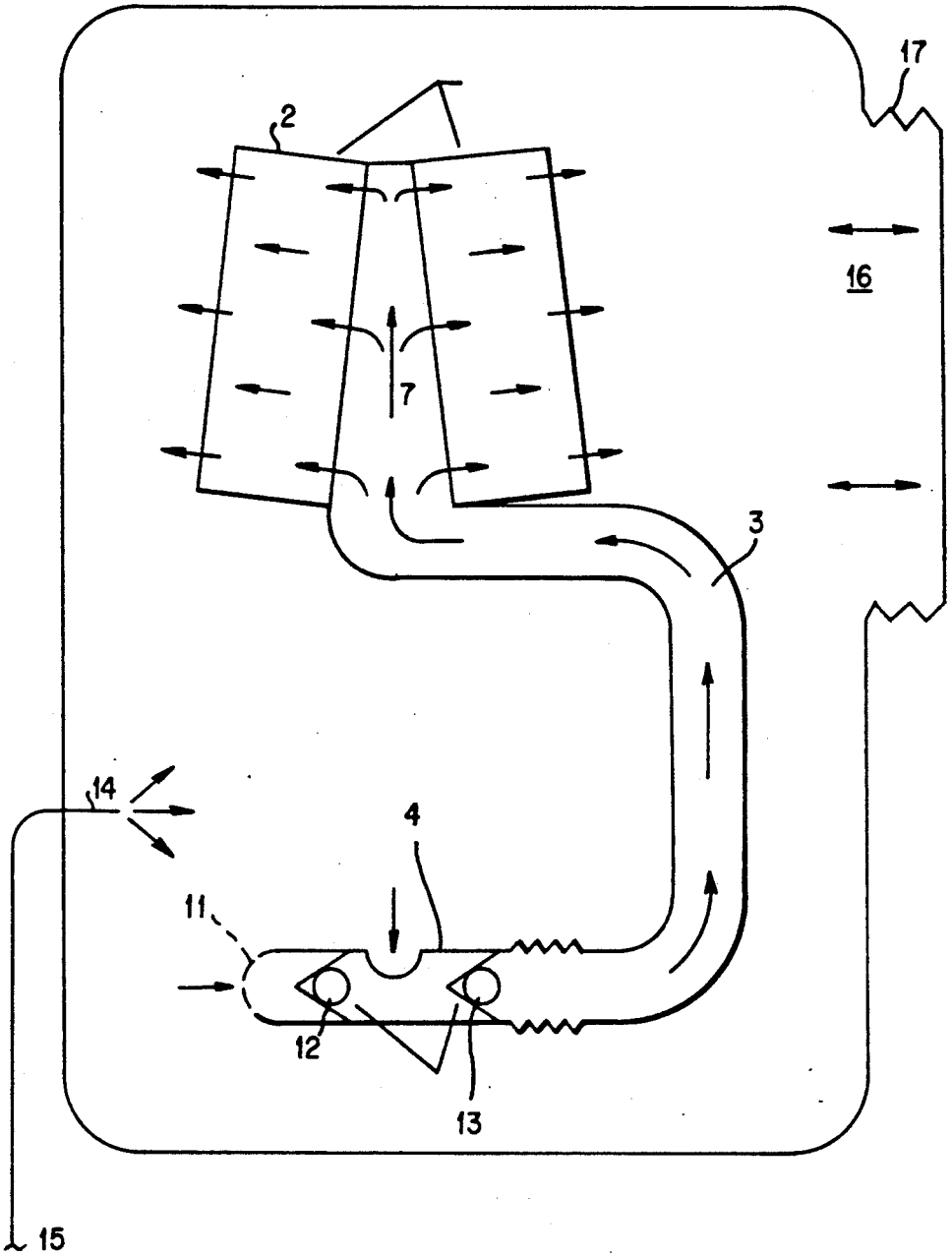
FIG. 5 is a schematic diagram of the breathing and gas recirculation system of the present invention.

FIG. 5 of the drawings illustrates schematically the gas purification and recirculation device of the invention. A retractable mouth piece 4 is provided with an inhalation screen 11 to prevent ingress of foreign material into the diver's respiratory system. Two check valves 12 and 13 are provided to assure that exhaled gas from the diver's mouth passes into the duct 3 leading to the canister 2 and not directly into the helmet environment and to permit the diver to inhale gas from the helmet. A flexible neck dam 16 is provided which encircles the diver's neck to prevent sea water from entering the helmet or gas from leaving the helmet. Folds are provided at 17 in the neck dam to permit enlargement to adjust the compliant volume of the system. Oxygen replenishment into the environment of the helmet is provided at 14 from auxiliary bottles 15 which are not shown. Excess gas is expelled to the outside through a spring loaded check valve.

Figure 6:
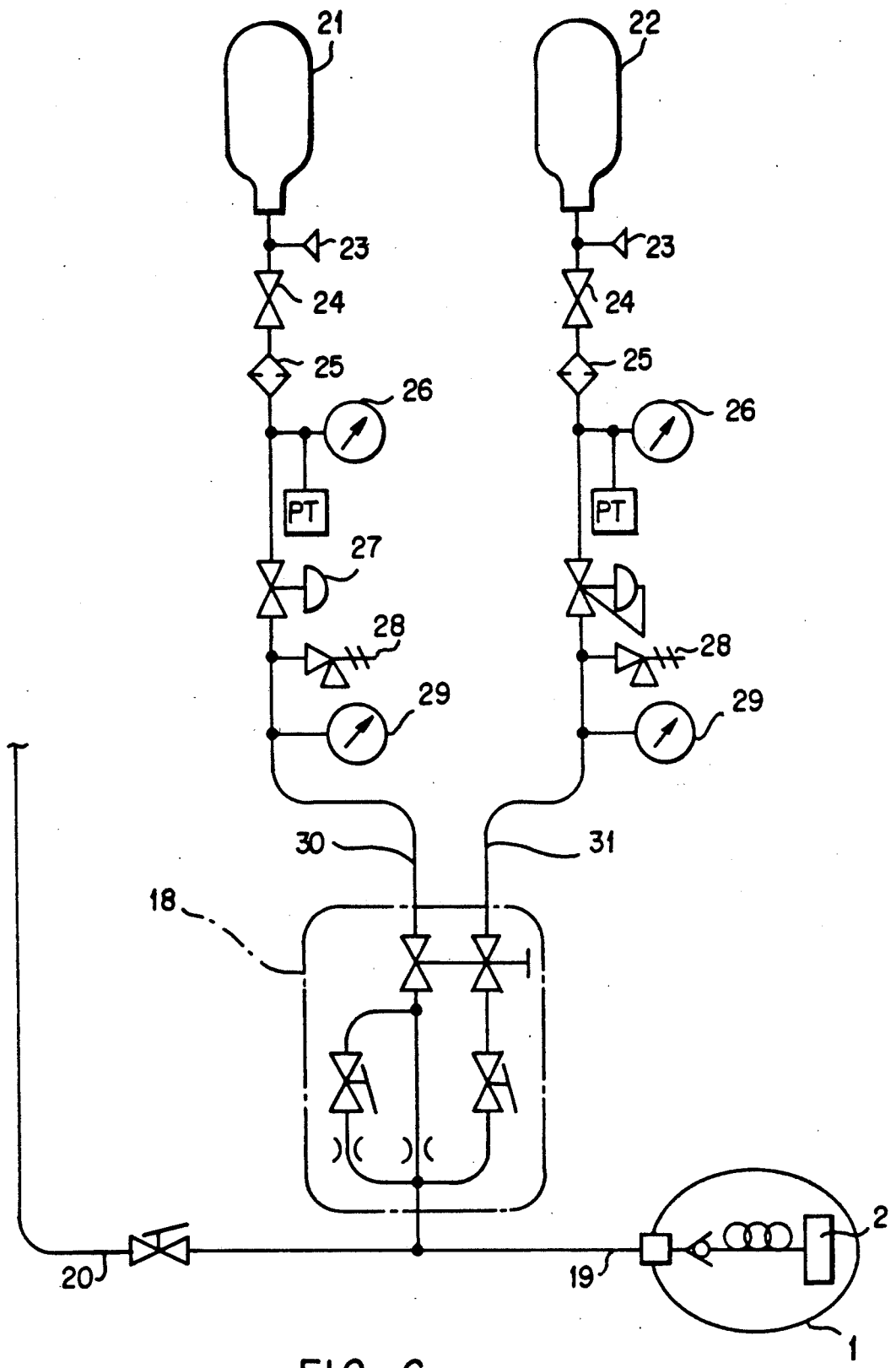
FIG. 6 is a schematic diagram illustrating the gas supply circuitry for the entire autonomous "bailout" and standby system used in accordance with the present invention.

FIG. 6 of the drawings illustrates schematically the entire gas supply circuitry of the system of the present invention including various control valves, filters and gages. In the standby mode, which is an intermediate mode used by the diver if his push-pull gas supply stops while his umbilical is still functional, the helmet 1 is provided with gas and heat exchange system herein described which is connected by tubes 19 and 20 to an external source of gas either in an underwater bell, submarine, submarine habitat or on the surface. When standby is also not functional, the diver must revert to autonomous bailout. The oxygen replenishment system for the helmet is provided by means of gas bottles 21 and 22 which typically contain a mixture of oxygen and helium. These are connected by lines 30 and 31, respectively, to control block 18 which in turn is connected into line 19 leading into the helmet. Blowout plugs 23 are provided in the respective lines leading from the bottles 21 and 22. In addition, each line leading to the control block assembly 18 is provided with valves 24, filters 25, tank pressure gages 26, regulator valves 27, relief valves 28 and pressure regulation gages 29. Gas bottle 21 which leads into control block assembly 18 through line 30 provides liter flow into the system while gas bottle 22 which leads into the control block assembly through line 31 provides volume makeup.

Figure 8:
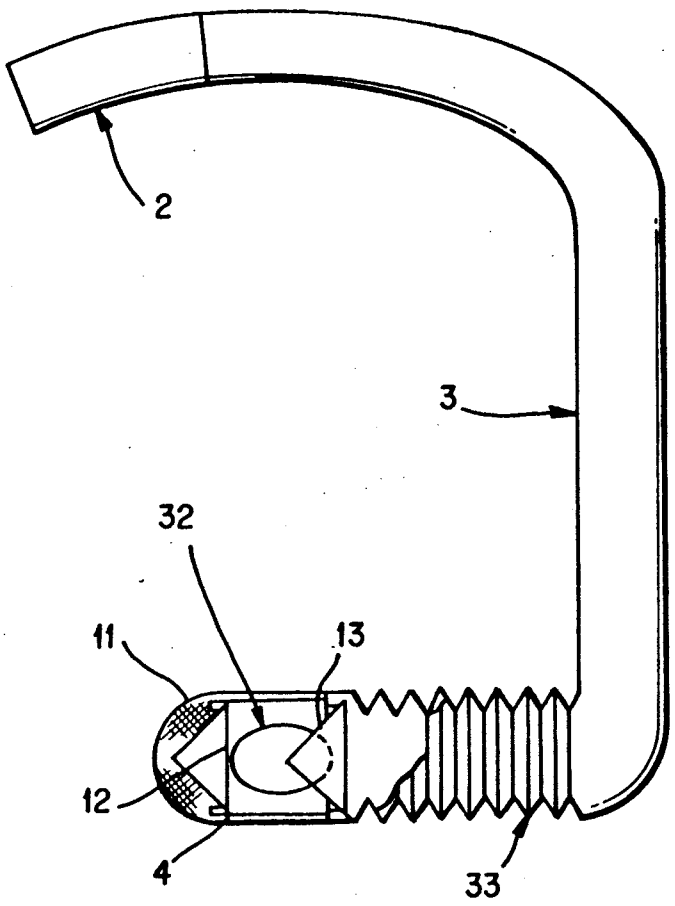
FIG. 8 illustrates the assembly of FIG. 7 with the mouthpiece in an extended position.
Figure 7:
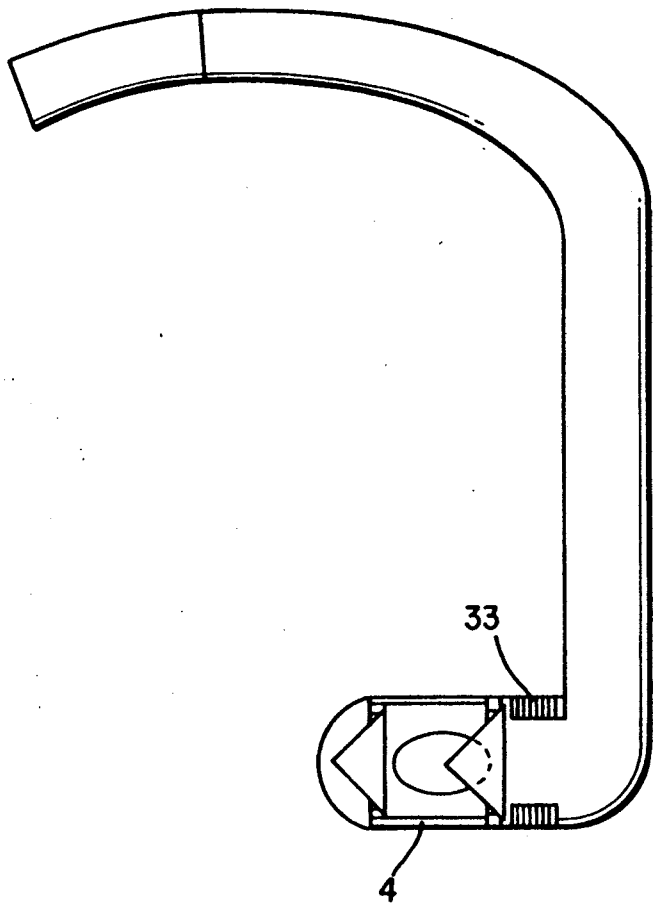
FIG. 7 is a front depiction of the mouthpiece, ducting and canister assembly with the mouthpiece in a retracted position.

FIGS. 7 and 8 of the drawings illustrate in detail the mouth piece and duct assembly which conveys exhausted gas from the diver's mouth to the canister of the present invention. As shown in FIG. 7 of the drawings, the mouth piece 4 connects to the duct 3 by means of a flexible, collapsable conduit 33 which is shown in its collapsed configuration in FIG. 7. In FIG. 8, the flexible duct assembly 33 is extended so that the mouth piece 4 is in position for the diver to use it. The manipulation assembly which permits the diver to engage the mouth piece is not illustrated in the drawing.

Figure 9A:
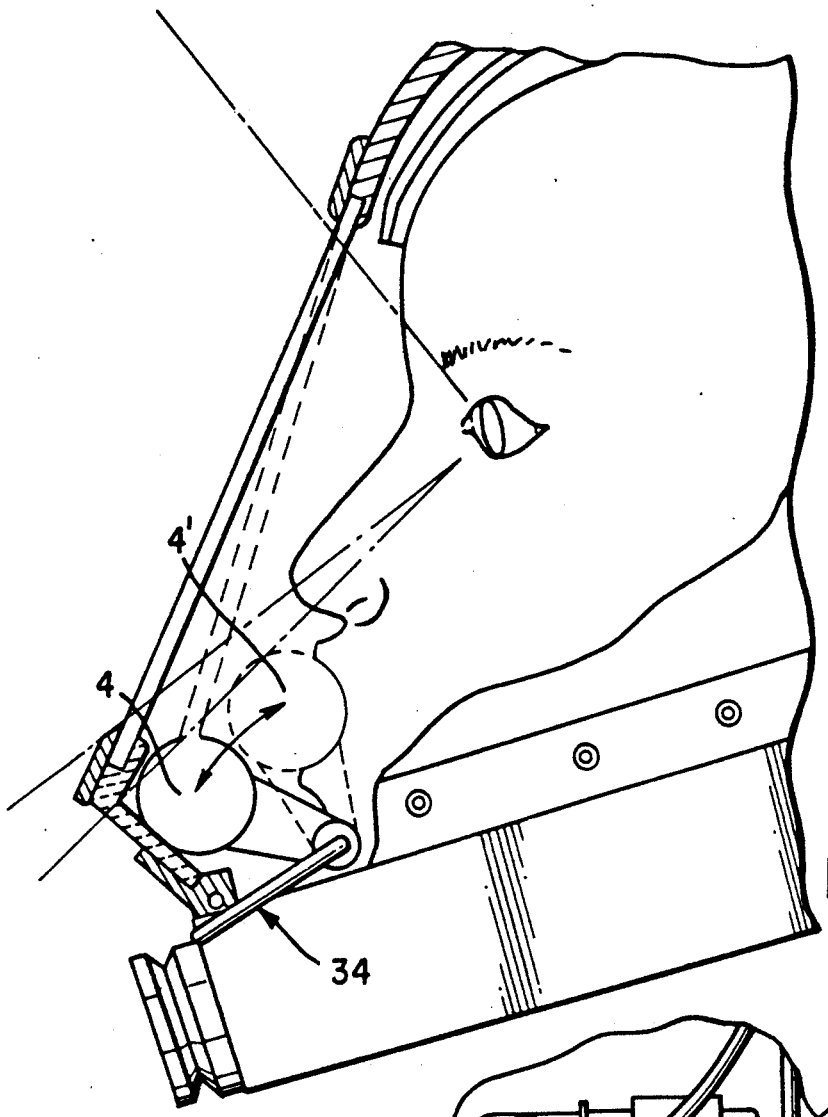
FIG. 9 is a side partial cutaway view illustrating the external activation lever used in accordance with the present invention to bring the mouthpiece into position for use.
Figure 9B:
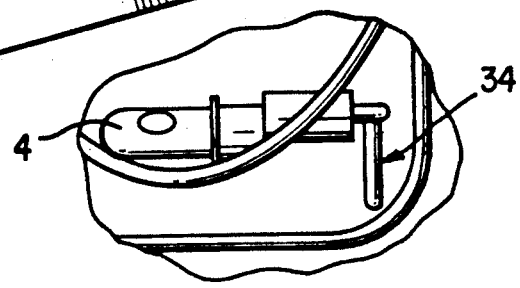

FIG. 9 of the drawings illustrates an alternative embodiment of the invention wherein the mouthpiece 4 is pivotally mounted so that it can be swung away or into engagement with the diver's mouth by means of an external lever 34 mounted on the outside of the helmet.

Figure 11:
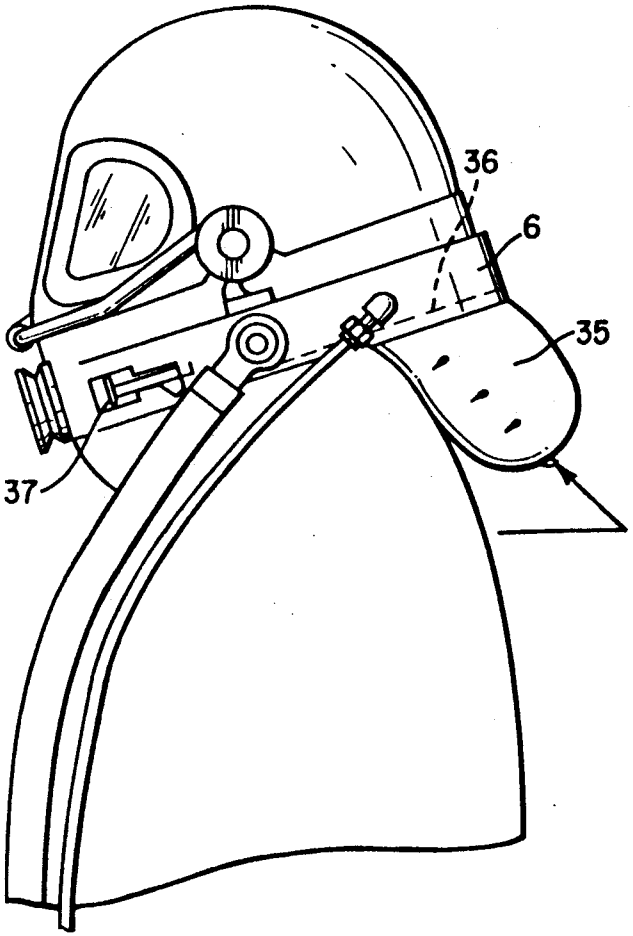
FIG. 11 illustrates the system of the present invention with the flexible neck dam released.
Figure 10:
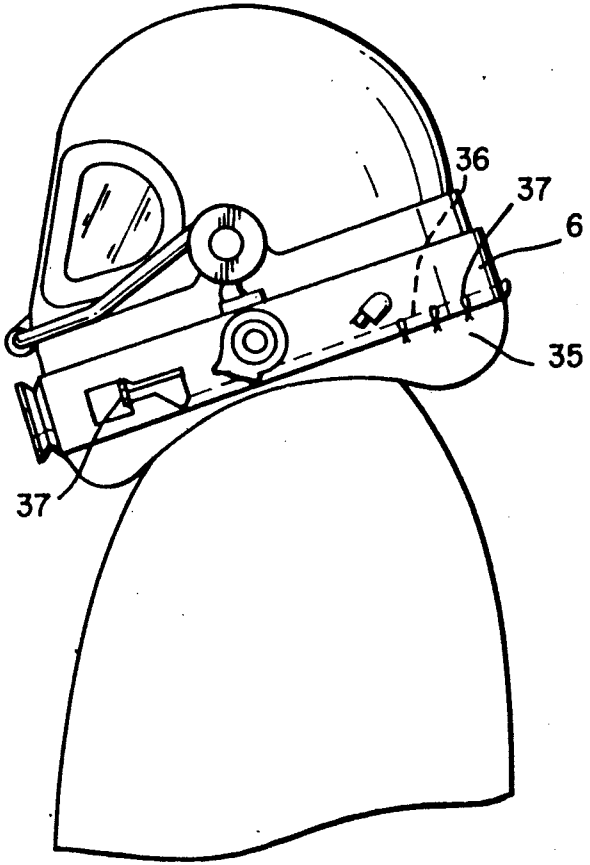
FIG. 10 is a side view illustrating the outer helmet in place with mechanism for restraining the flexible neck dam.

FIGS. 10 and 11 of the drawings illustrate the way in which the adjustable neck dam 35 can be released to increase the compliant volume of the system. This becomes necessary because the "normal" compliant volume of the neck dam is not large enough to match most divers' tidal volume and therefore must be increased to be used as a bailout counterlung. Prior to release, the flexible neck dam 35 is folded and tucked up within and around the valve ring 6 onto which the helmet 1 is attached. Eyelets 37 are provided on the flexible folds of the neck dam and engage the release wire 36 which passes around the valve ring 6. A release handle 37 is provided on the front portion of the valve ring where it is easily accessible to the diver. When the system of the present invention is engaged such as during an emergency where support from external power and breathing gas have been terminated, the diver can enlarge the compliant volume of the helmet to facilitate breathing within the helmet by engaging the release handle so that the eyelets are released and the flexible collar 35 expands as shown in FIG. 11 of the drawings.

A particularly important and significant aspect of the present invention is the preservation of heat within the environment of the helmet. Loss of this heat has heretofore been a significant problem during dives at considerable depths or in water temperatures which are very cold. The present system by being fully contained within the helmet permits the heat generated by the diver as well as that generated by the absoption of carbon dioxide from exhaled gas to be preserved within the helmet, thereby reducing respiratory heat loss. In addition, during normal non-emergency operations when the diver's helmet is connected to an external source of gas and heat originating on the surface or in a bell, the heated gas flowing into the helmet maintains the canister in a relatively warm condition where it is ready to instantly function should it be needed during autonomous operation. In contrast, one of the further difficulties which has been encountered in bail out or backup systems using externally mounted canisters has been that these canisters become cold and therefore function considerably less efficiently initially to remove carbon dioxide from expended gas and can cause thermal shock. The present system by maintaining the canister in a heated condition is instantly ready to function and remove carbon dioxide from the exhaled gas at optimum efficiency.

Although the present invention has been described with respect to a preferred embodiment thereof, it will be apparent to those of ordinary skill in the art that other modifications are available which can be practiced within the scope of the claims appended hereto.

What is claimed:

1. An underwater diver's headgear comprising
1. an outer helmet
2. an inner liner adapted to fit in spaced relationship within said helmet
3. a neck dam means to prevent ingress of water into or egress of gas out of the headgear
4. means connected to an external supply for providing supplemental gas to said headgear
5. gas recirculation means entirely contained within the interior of said headgear for removing $CO_2$ from exhausted gas within said helmet, conserving respiratory heat, and providing heat to the interior environment of the headgear, said gas recirculation means comprising a mouthpiece for receiving exhausted gas from the diver using the helmet, ducting means connected to said mouthpiece for conveying said exhausted gas to a purification means containing a chemically reactive absorbent for removing $CO_2$ from said gas by means of an exothermic reaction which produces heat which is dispelled from said purification means into the environment of the helmet along with recirculating gas from which the $CO_2$ has been removed; said recirculation means being shaped to conform to and fit within space provided in the upper dome of the helmet between said liner and the upper interior surface of the helmet.

2. The diver's headgear of claim 1 wherein said space between the purification means and the interior helmet surface is variable.

3. The headgear of claim 1 wherein said purification means is an air permeable curved planar canister having plural chambers containing said absorbent and a common plenum means for distributing untreated, exhaled gas to said chambers, said plenum means being connected to said ducting means to receive said exhaled gas.

4. An underwater diver's headgear comprising 1. an outer helmet
2. a neck dam means to prevent ingress of water into or egress of gas out of the headgear.
3. means connected to an external supply for providing supplemental gas to said headgear
4. two way gas recirculation means entirely contained within the interior of said headgear for removing $CO_2$ from exhausted gas within said helmet, conserving respiratory heat, and providing heat to the interior environment of the headgear, said gas recirculation means comprising a mouthpiece for providing breathing gas to and removing exhausted gas from the diver using the helmet, ducting means connected to said mouthpiece for conveying said gas to and from a purification means containing a chemically reactive absorbent for removing $CO_2$ from said gas by means of an exothermic reaction which produces heat which is dispelled from said purification means into the environment of the helmet along with recirculating gas from which the $CO_2$ has been removed; said recirculation means being shaped to conform to and fit within said helmet.

5. The headgear of claim 4 wherein said mouthpiece is retractable.

6. The headgear of claim 4 wherein said mouthpiece is provided with a filter means to prevent particle ingress from the helmet environment during inhalation.

7. The headgear of claim 1 wherein said mouthpiece is provided with a first one-way valve to prevent direct passage of exhaled gas into the helmet environment and a second one-way valve is provided in said ducting means to prevent direct passage of gas from said ducting means back to said mouthpiece.

8. The headgear of claim 4 which further includes means for attachment of external support.

9. The headgear of claim 8 in which said external support includes breathing gas and heat.

10. An underwater diver's headgear comprising 1. an outer helmet
2. a neck dam means to prevent ingress of water into or egress of gas out of the headgear.
3. means connected to an external supply for providing supplemental gas to said headgear
4. gas recirculation means entirely contained within the interior of said headgear for removing $CO_2$ from exhausted gas within said helmet, conserving respiratory heat, and providing heat to the interior environment of the headgear, said gas recirculation means comprising a mouthpiece for providing breathing gas to and removing exhausted gas from the diver using the helmet, ducting means connected to said mouthpiece for receiving exhausted gas from the diver using the helmet, ducting means connected to said mouthpiece for conveying said exhausted gas to a purification means containing a chemically reactive absorbent for removing $CO_2$ from said gas by means of an exothermic reaction which produces heat which is dispelled from said purification means into the environment of the helmet along with recirculating gas from which the $CO_2$ has been removed; said recirculation means being shaped to conform to and fit within said helmet.

11. The headgear of claim 4 wherein said mouthpiece is retractable.

12. The headgear of claim 4 wherein said mouthpiece is provided with a filter means to prevent particle ingress from the helmet environment during inhalation.

13. The headgear of claim 10 wherein said mouthpiece is provided with a first one-way valve to prevent direct passage of exhaled gas into the helmet environment and a second one-way valve is provided in said ducting means to prevent direct passage of gas from said ducting means back to said mouthpiece.

14. The headgear of claim 10 which further includes means for attachment of external support.

15. The headgear of claim 14 in which said external support includes breathing gas and heat.

* * * * *